United States Patent [19]

Grotz

[11] Patent Number: 4,484,019

[45] Date of Patent: Nov. 20, 1984

[54] HIGH VOLTAGE RF FEEDTHROUGH BUSHING

[75] Inventor: Glenn F. Grotz, Huntington Station, N.Y.

[73] Assignee: The United States of America as represented by the Department of Energy, Washington, D.C.

[21] Appl. No.: 414,543

[22] Filed: Sep. 3, 1982

[51] Int. Cl.[3] ..... H01B 17/26; H01B 17/42

[52] U.S. Cl. ..... 174/9 R; 174/15 BH; 174/31 R; 174/142

[58] Field of Search ..... 343/906; 174/9 R, 15 BH, 174/31 R, 142

[56] References Cited

U.S. PATENT DOCUMENTS 3,440,326 4/1969 Lair ..... 174/9 R 3,902,000 8/1975 Forsyth et al. ..... 174/15 BH

*Primary Examiner*—Eli Lieberman

*Attorney, Agent, or Firm*—Bruce R. Mansfield; Paul A. Gottlieb; Michael F. Esposito

[57] ABSTRACT

Described is a multi-element, high voltage radio frequency bushing for transmitting RF energy to an antenna located in a vacuum container. The bushing includes a center conductor of complex geometrical shape, an outer coaxial shield conductor, and a thin-walled hollow truncated cone insulator disposed between central and outer conductors. The shape of the center conductor, which includes a reverse curvature portion formed of a radially inwardly directed shoulder and a convex portion, controls the uniformity of the axial surface gradient on the insulator cone. The outer shield has a first substantially cylindrical portion and a second radially inwardly extending truncated cone portion.

8 Claims, 2 Drawing Figures

HIGH VOLTAGE RF FEEDTHROUGH BUSHING

CONTRACTUAL ORIGIN OF THE INVENTION

The United States Government has rights in this invention pursuant to Contract No. DE-AC02-76CH03073 between the U.S. Department of Energy and Princeton University.

BACKGROUND OF THE INVENTION

The present invention pertains to high voltage coaxial feedthrough bushings, and in particular to such bushings having complicated geometrical shapes. The bushing of this invention is directed to radio frequency (RF) electrical systems operated at frequencies of 300 megahertz or less, voltages of 100 KV or less, and power levels of at least 1 megawatt.

One application for such bushings is in the Princeton Large Torus Ion Cyclotron Resonant Frequency analysis being conducted at the Princeton Plasma Physics Laboratory. These experiments are directed to a particular method of heating a magnetically confined plasma, by launching RF fields into the plasma. Once the RF fields are launched into the plasma, energetic charged particles that will interact with the tokamak walls can be excited. Surface physics problems associated with RF heating of tokamak plasma can be classified into material interaction with RF fields in plasma particles. To maximize the power coupling of the plasma, both the voltage standoff and current carrying capacity of the RF components need to be optimized. The power transmission of the Princeton Large Torus Ion Cyclotron Resonant Frequency experiments is presently limited by voltage breakdown in the vacuum feed through bushing.

Conventional bushings employ a ceramic or other dielectric structural member which maintains the alignment of inner and outer coaxial conductors. The dielectric mass to be employed within the bushing should be reduced so as to minimize charging current, but must not be reduced to the point where electrical and mechanical strength of the bushing is degraded. Further improvements in the dielectric member can be realized if the path length of the outer surface of the internal insulator member is maximized without hampering the control of uniform electrical stress appearing across the dielectric surface.

In addition, if the bushing having the aforementioned advantages is to comprise in an upgraded replacement in an existing installation, it must provide higher voltage and power levels while meeting the length and girth restrictions imposed by a particular installation.

Electrical feedthrough bushings of the type to which the invention is directed must provide a barrier between a gas-filled environment and a hard vacuum, while transmitting high levels of voltage, frequency and power into the electrical load. For the purpose of the invention, a "hard" vacuum is defined as being at least as great as $10^{-6}$ Torr.

Vacuum integrity during operation of the bushings used in the Laboratory must be maintained to a very high degree at all times, since impurity influx during operation of a magnetic confinement device would severely degrade, if not destroy operation thereof, requiring protracted down-time for the extraction of the impurity.

The high voltage electrical art has long recognized the difficulties in determining electric field stress in various dielectric materials arranged in complex geometrical forms. However, such complex forms offer the possibility of enhanced bushing performance if the proper interaction between electrically conductive and dielectric components of the bushing could be achieved.

It is therefore an object of the present invention to provide a compact high voltage RF bushing having increased voltage standoff.

Another object of the present invention is to provide a compact high voltage RF bushing having increased power handling capability.

Yet another object of the present invention is to provide a high power RF bushing which provides control of the internal electric field within the bushing so as to substantially eliminate regions of increased electrical stress.

Another object of the present invention is to provide, within a gas-filled bushing having an inner and an outer electrical conductor separated by a dielectric member, a maximized path length along the surface of the dielectric member so that the product of the surface gradient and the ceramic dielectric constant is less than the breakdown strength of the dielectric gas during normal operation.

Yet another object of the present invention is to provide a high voltage RF bushing in which the electric field therewithin is controlled to obtain a uniform stress across the dielectric surface, while controlling the ratio of the outer and inner diameters of the dielectric member to be the electrical constant "e" where possible to minimize surface gradients.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other objects of the present invention are provided by a bushing comprising an inner central conductor, an outer shielding coaxial conductor, and an insulator support member disposed therebetween for maintaining the relative alignment between inner and outer conductors. The center conductor is shaped to have a complex outside surface which, during electrical operation of the bushing, interacts with the shielding conductor and insulator support member so as to minimize axial and radial electrical field stress within the bushing. More particularly, the center conductor is shaped to control the uniformity of the axial surface gradient on the insulator surfaces. The support member, a thin-walled hollow truncated cone, cooperates with the inner and outer conductors so as to dispose the least amount of dielectric material in the radially-directed electric field set up within the bushing. The support member is also configured to provide the maximum path length within the space between a given inner and outer conductor arrangement. One side of the bushing is connected to a gas-filled power source, while the other side is connected to a hard vacuum electrical system wherein the vacuum is at least $10^{-6}$ Torr.

BRIEF DESCRIPTION OF THE DRAWINGS

In the drawings, where like elements are referenced alike.

DETAILED DESCRIPTION OF THE PREFERRED EMBODIMENT

Figure 1:
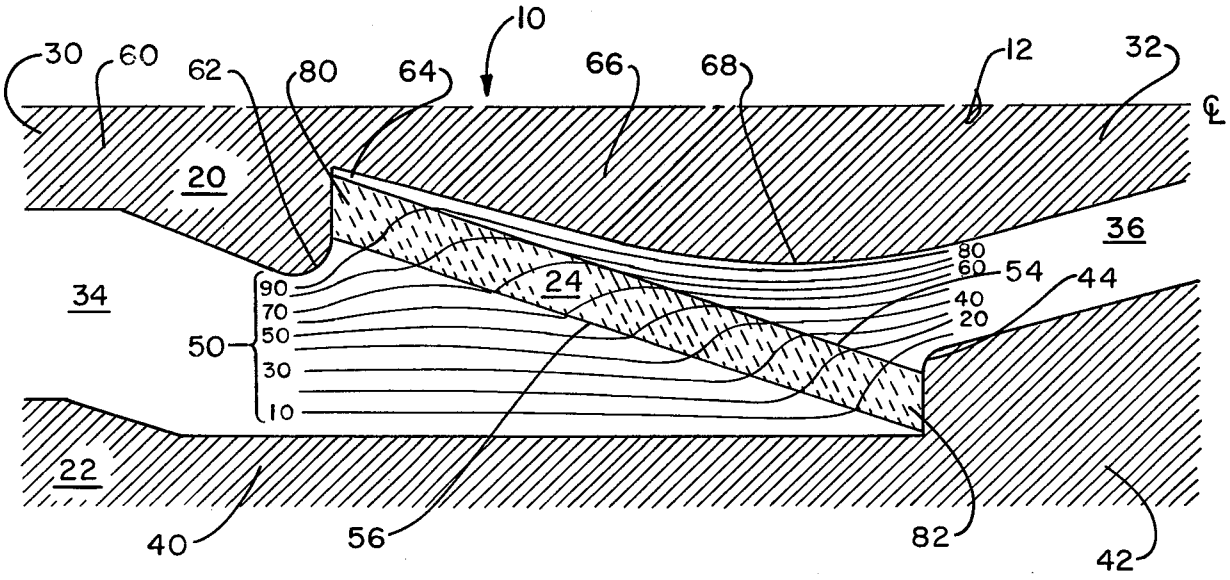
FIG. 1 is a partial cross section of an idealized coaxial high voltage RF vacuum barrier feedthrough bushing of the present invention.

Referring now to the drawings and especially to FIG. 1, a partial view of a high voltage, high power RF feedthrough bushing 10 according to the invention is shown. FIG. 1 shows one-half of a cross-sectional view of bushing 10, wherein numeral 12 is applied to a centerline or axis of the bushing. Centerline 12 comprises an axis of revolution for the partial view of FIG. 1.

Bushing 10 comprises an inner coaxial or center conductor 20, an outer coaxial conductor or shield 22 and an insulator member 24. An upstream end 30 of center conductor 20 is connected to a gas-filled high voltage coaxial transmission line or other suitable source of high voltage RF power, while downstream end 32 of center conductor 20 is connected to an RF antenna or other electrical load disposed in a hard vacuum. Insulator 24 forms a vacuum barrier between a gas-filled annular cavity 34 (located at upstream end 30) and a hard vacuum cavity 36 (located at downstream end 32). In the preferred embodiment, cavity 34 is filled with $SF_6$ dielectric gas maintained at a pressure of about atmospheric level. Cavity 36 contains a "hard" vacuum herein defined as at least $10^{-6}$ torr.

Center conductor 20, outer shield 22, and insulator 24 are configured so as to interact to form a bushing having high maximum voltage capability at increased power levels. The combination also provides a substantially low minimal dielectric stress and stored energy in the insulator 24, while providing uniform electric stress across the surface thereof.

Whereas previous bushing constructions of this type have a complicated outer shield shape, the shape of outer shield 22 is relatively simple, comprising first and second cylindrical portions 39, 40, and a third constricted portion 42. First portion 39 has a predetermined inner diameter and includes means for electrical connection with a pressurized. gas-filled electrical power source, not shown in the drawing. Second portion 40, which partially surrounds gas-filled cavity 34, has an inner diameter greater than that of portion 39. The third body portion 42 which partially defines vacuum cavity 36, comprises a truncated cone, wherein the smaller diameter end is located adjacent section 40. The larger diameter end of truncated conical section 42 is the most radially inwardly projecting point in either the gas-filled or evacuated cavities 34, 36, respectively. One end of the third body portion 42 forms a shoulder 44 for supporting the forces of center conductor 20 which are transmitted through insulator 24. The reduced diameter portion 42 of outer shield 22 is disposed adjacent the downstream end of concave portion 66 of center conductor 22 so as to form a corona shield which eliminates metalization and other breakdown problems resulting from arcing along the downstream portion of concave section 66.

The outer surface of center conductor 20 has a complex geometric shape which controls the voltage gradient, or electrical stress distribution between center conductor 20, outer shield 22 and insulator 24. Referring to FIG. 1, the configuration of the outer surface of conductor 20 includes three high voltage body portions: an upstream constant diameter portion 60, a medial collar-like shoulder portion 62, and a downstream convex portion 66. Shoulder 62 transfers the weight of center conductor 20 to outer shield 22, through insulator 24. The outside diameter of shoulder 62 is greater than the diameter of end portion 30 so as to provide an electrical shield therefor. Center conductor 20 is configured to provide a gap 64 adjacent the brazed joinder of insulator 24 and conductor 20, so as to shield the metal/dielectric joint by minimizing the axial electric field in that region.

The convex section 66 of conductor 20 is located adjacent insulator 24, shoulder 44 of shield 22, and defines the radially inner surface of evacuated cavity 36. In terms of its solid form, section 66 comprises a substantially oblate ellipsoid, wherein the term "ellipsoid" is not limited to the precise mathematical meaning, but rather includes any solid form having an enlarged midsection. The ellipsoidal section 66 has a first truncated polar end adjacent gap 64, and a second truncated polar end 32 located adjacent cavity 36. Downstream end 32 of center conductor 20 includes means for connection to an electrical load, not shown in the drawings. The maximal diameter of section 66 is greater than the diameter of section 60, but less than the diameter of shoulder 62. The point of maximum concavity denoted by reference number 68, can be seen to lie adjacent the end of insulator 24 which is joined to shoulder 44 of shield 22.

Insulator 24, a thin-walled hollow truncated cone, is made of machinable ceramic dielectric having inner and outer uniformly tapered surfaces that are substantially parallel to each other. Insulator member 24 coaxially aligned with center conductor 22, is arranged in vacuum sealing contact therewith at portions immediately adjacent shoulder 62. This contact is made with the reduced diameter end 80 of member 24, so that the internal diameter of that member increases at portions adjacent the concave portion 66 of center conductor 22. The large outer diameter end 82 of member 24 is arranged in vacuum sealing contact with shoulder 44 of shield 22.

Member 24, performing the functions of an electric insulator and a mechanical support, is preferably made from a machinable high silicon, ceramic or glass material, such as the Macor brand of silicon glass. The end of member 24 are microbrazed with a nickel alloy so as to form a vacuum seal with outer shield 22 and center conductor 20. The hollow, thin-walled truncated cone configuration of member 24 disposes a minimum amount of dielectric material in the path of the axial electric field set up within the bushing. That is, member 24 has a uniform predeterminedly small thickness which lies in the path of the electric field of the bushing. Member 24 has opposed inner and outer surfaces 54, 56 which lie perpendicular to the direction of impressed electric field. As a result, charging current and energy stored in insulator 24, during operation of the bushing, are minimized. The insulator of this invention minimizes dielectric mass, while maximizing the path length along its outer and inner surfaces 54, 56, within the space afforded between inner conductor 20 and outer shield 22. Center conductor 20, and especially portion 66 thereof, have a complex shape which uniformly distributes the electric field across the surfaces of insulator 24, so as to obtain a low electric field gradient parallel to the insulator surfaces. Consequently, no capacitive grading or the like is employed in the insulator construction. This allows for compact construction by eliminating the need for an enlarged outer shield assembly.

Figure 2:
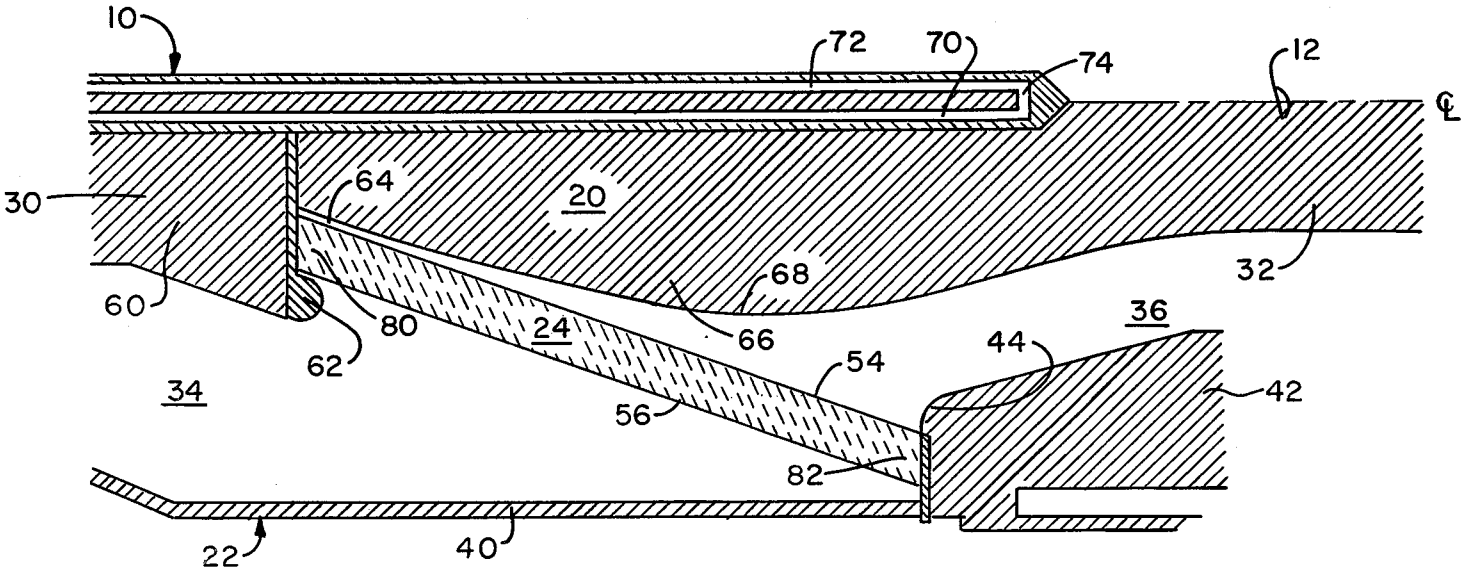
FIG. 2 is a partial cross section of a practical embodiment of the bushing of FIG. 1.

Referring now to FIG. 2, a partial cross-section of a practical embodiment of the bushing of FIG. 1 is shown. In order to supply the desired increased RF power, central conductor 20 is water cooled. Accordingly, central conductor 20 is shaped from one longitudinally extending piece of copper, titanium or the like conductor materials, to provide integral inlet and outlet channels 70, 72, as well as a connecting channel 74. The channels are connected to a liquid source not shown in the drawings, for circulating cooling fluid through the central conductor without affecting the strength or vacuum integrity of the bushing. The pressure-tight, parallel inlet and outlet and connecting channels form a coaxial dead-end or "U" in the central conductor shown in the embodiment of FIG. 2. This configuration accommodates circulating coolant along a portion of the longitudinally extending coaxial central conductor 20. In one manufacturing sequence, the channels 70, 72 are formed in an insert that is drilled in a solid conductor made from copper, and the ends of the connecting channels are suitably enclosed by brazing or welding to form an integral vacuum-tight container for the liquid coolant.

The outer shield 22 comprises a coaxial vacuum container wall which includes a corona shield portion 42 for the metal/ceramic joint adjacent end 82 of insulator 24. In the practical embodiment of FIG. 2, the shield 22 has a shoulder or inner smoothly decreasing inside diameter portion 44 that substantially faces the decreasing downstream end of convex portion 66 of center conductor 20, so as to prevent electrical breakdown. Shoulder 62 of center conductor 20, extends radially outwardly beyond the adjacent end 80 of insulator 24, by an amount approximately equal to the thickness of insulator 24. This extension shields the metal/ceramic joint of members 20,24.

As can been seen in FIGS. 1 and 2, insulator 24 comprises a hollow, thin-walled cone having a narrow end 80 of diameter smaller than that of broad end 82.

When operating at 100 KV, the product of the axial surface gradient and the dielectric constant of insulator 24 yields a stress of 159 volts per mil at the most highly stressed point on the insulator surface 56. The most highly stressed point on the center conductor in the gas cavity 34 is stressed at 157 volts per mil.

The maximum stress in the region of the bushing in evacuated cavity 36 is 216 volts per mil or 85 kilovolts per centimeter which is a nominal level in a good vacuum. With the bushing of this invention, the vacuum integrity of hard vacuum cavity 36 is maintained under actual RF operation, at high voltage up to 100 KV, radio frequencies up to 300 megahertz, and elevated power levels. This performance represents a significant improvement over prior bushings which could not adequately maintain a flow of power at 40 KV, in that internal voltage breakdown within the bushing was experienced. Numeral 50 is applied to equipotential electric field lines in the bushing, illustrating the controlled electric field distribution wherein voltage gradients are reduced to a minimum.

The voltage gradients 50 of FIG. 1 are denoted by a series of numbers located adjacent to the electric field lines. The numbers represent voltages when a nominal 100 volts is applied to the central conductor 20. Since sharp edges are eliminated and the lines are substantially evenly and widely spaced, the gradients are uniformly low and the stresses are likewise relatively low. This advantageous distribution results from the interaction of center conductor 20, outer shield 22 and insulator 24. Moderate nitrogen pressurization will help prevent breakdown at 100 KV but sulfur hexafluoride may be used as an alternative. Bushing 10 is capable of successful operation at greater than 100 KV with moderate nitrogen pressurization on the upstream side of cavity 34, and $10^{-6}$ torr or greater on the vacuum side adjacent cavity 36.

The increased voltage standoff, electric field control, and other advantageous operating characteristics of the complexly configured center conductor 22, the support member 24 and the outer shield 26, were verified by a computer-derived model as described in "High voltage RF Coaxial Vacuum Bushing Design Considerations" by G. Grotz (the inventor of the present invention) and N. Greenough, which was presented at the Ninth Symposium on Engineering Problems of Fusion Research, Chicago, Ill. Oct. 26–29, 1981. As described in this article, the use of a computer program overcomes the difficulty in determining the electric field stress and the breakdown in various dielectric materials of this invention, which are shaped in complex geometric forms. Thus, the use of the expensive, cumbersome, time-consuming and difficult-to-use electrolytic tanks, conductive paper, model testing and over-voltages known heretofor, are avoided.

The bushing of FIG. 2 was developed for the Ion Cyclotron Resonant Heating (ICRH) investigations at the Princeton Plasma Physics Laboratory. In that application, a loop-like RF antenna was connected immediately adjacent the downstream end 32 of center conductor 20. The inductance of this antenna resonates with the capacitance of the bushing at the Ion Cyclotron Resonant Frequency. Accordingly, the bushing of FIG. 2 was not arranged for characteristic impedance termination, or maximum power transfer. Such termination could be designed by one skilled in the art, but only at the cost of compromising the voltage standoff of the bushing. Nonethless, the bushing of the present invention afforded an increase in operating voltage from 40 KV to 100 KV with the attended power increase varying as the square of the voltage. Although power transfer was not maximized in the design of the present invention, it was increased as much as possible, consistent with the increase voltage standoff capability. Further, the bushing of the present invention was designed within existing size restrictions, a diameter of approximately 5 inches, and a length of approximately 6 inches.

It can be seen that the bushing of the present invention has a shaped center conductor which, in cooperation with the outer shield and insulator member, overcomes overvoltage and breakdown problems heretofor encountered in heating plasmas with ICRF. To this end, this invention has the advantage of providing a reverse curvature central conductor and a coaxial insulator member for supplying a coaxial, high-voltage vacuum barrier, radio frequency feedthrough bushing for a high vacuum container for supplying radio frequency energy from a relatively high pressure gas of the outside of the container to the vacuum inside the container.

The embodiments of the invention in which an exclusive property or privilege is claimed are defined as follows:

1. In a high voltage radio frequency bushing having inner and outer coaxial conductors and connectable to a pressurized electrical system and a hard vacuum electrical system for transmitting high voltage radio frequency energy therebetween, the improvement comprising:

a. an inner coaxial conductor having:

(i) a first high voltage end including means for electrical connection to said pressurized electrical system and a second high voltage end including means for electrical connection to said hard vacuum electrical system;

(ii) first, second and third high voltage body portions sequentially disposed between said first and said second high voltage ends of said inner coaxial conductor, respectively;

(iii) said first high voltage body portion having a predetermined first reference outer diameter;

(iv) said second high voltage body portion including a radially outwardly extending collar-like member having an extreme outside diameter greater than said first reference outer diameter;

(v) said third high voltage body portion comprising a substantially oblate ellipsoid with a first truncated polar end contiguous with said second high voltage body portion, and a second polar end located adjacent said second high voltage end of said inner coaxial conductor, said substantially oblate ellipsoid having a maximal outside diameter greater than said first reference diameter and less than said extreme outside diameter of said collar-like member of said second high voltage body portion;

b. an outer coaxial conductor having (i) a first shielding end including means for electrical connection to said pressurized electrical system;

(ii) a second shielding end including means for electrical connection to said hard vacuum electrical system;

(iii) first, second and third shielding body portions sequentially disposed between said first and said second shielding ends, respectively;

(iv) said first shielding body portion having a predetermined second reference inner diameter positioned adjacent said first shielding end of said outer coaxial conductor so as to radially oppose said first high-voltage body portion of said inner conductor;

(v) said second shielding body portion having an interior diameter greater than said second reference diameter and positioned to radially oppose said second and said third high voltage body portions of said inner coaxial conductor;

(vi) said third shielding body portion having first and second ends and an inner cone-like surface, with said first end contiguous with said second shielding body portion and having a maximum inner diameter less than said second reference diameter and with said second end contiguous with said second shielding end of said outer coaxial conductor and having an inner radius less than said inner radius of said first end of said third shielding body portion;

(vii) shoulder means contiguous with and disposed between said second and said third shielding body portions of said outer coaxial conductor so as to radially oppose portions of said inner coaxial conductor which lie between said maximal outside diameter and said second end of said third high voltage body portion; and c. an insulator member disposed between said collar of said second high voltage conductor portion of said inner coaxial conductor and said shoulder means of said outer coaxial conductor, comprising a hollow, thin-walled truncated cone with a first smaller diameter end joined to said collar-like member of said second high voltage body portion of said inner conductor in a vacuum-tight manner, and a second larger diameter end joined to said shoulder of said outer coaxial conductor in a vacuum-tight manner.

2. The arrangement of claim 1 wherein said first and said second high voltage body portions, said first and said second shielding body portions and said insulator member comprise pressure containment means for a dielectric gas.

3. The arrangement of claim 2 wherein said third high voltage body portion, said third shielding portion and said insulator member comprise hard vacuum containment means.

4. The arrangement of claim 1 wherein said second shielding body portion radially opposes the maximal outside diameter of said third high voltage body portion.

5. The arrangement of claim 1 wherein said ends of said insulator are joined to said inner and said outer coaxial conductors by vacuum-tight brazing.

6. The arrangement of claim 5 wherein said second high voltage body portion comprises a corona shield for the brazed joinder of said insulator member and said inner coaxial conductor.

7. The arrangement of claim 5 wherein said shoulder means of said outer coaxial conductor comprises a corona shield of the brazing joinder of said insulator member and said outer coaxial conductor.

8. The arrangement of claim 1 wherein said inner coaxial conductor further comprises axially extending cooling channels.

* * * * *